United States Patent [19]

Roller

[11] Patent Number: 4,687,045

[45] Date of Patent: Aug. 18, 1987

[54] PROJECTILE-CASTING INGOT MOLD

[76] Inventor: Johannes Roller, A-1070 Wien Siebensterngasse 43, Vienna, Austria

[21] Appl. No.: 846,598

[22] Filed: Mar. 31, 1986

[30] Foreign Application Priority Data

Apr. 9, 1985 [AT] Austria ..... 1057/85

[51] Int. Cl.[4] ..... B22D 31/00

[52] U.S. Cl. ..... 164/262; 164/264; 164/342; 164/348; 249/135

[58] Field of Search ..... 164/69.1, 70.1, 122, 164/137, 138, 262, 264, 342, 348; 249/108, 116, 135, 155, 161, 187 C

[56] References Cited

U.S. PATENT DOCUMENTS

| | | | |
|---|---|---|---|
| 0,904,273 | 11/1908 | Mundt | 164/342 |
| 1,584,954 | 5/1926 | Lee et al. | 164/342 |
| 1,884,291 | 10/1932 | Schurer | 249/135 |
| 1,910,015 | 5/1933 | Homand | 249/187 C |
| 2,114,015 | 4/1938 | Cramer | 164/264 |
| 3,745,873 | 7/1973 | Lee | 164/264 |

*Primary Examiner*—Nicholas P. Godici
*Assistant Examiner*—Richard K. Seidel
*Attorney, Agent, or Firm*—Kurt Kelman

[57] ABSTRACT

High casting rates and consistently precise dimensions of lead and lead alloy projectiles are obtained with an ingot mold comprising two like ingot mold halves having abutting sides and upper and lower sides extending outwardly therefrom, the abutting mold half sides defining like cavity halves open towards the upper sides of the mold halves and forming a mold cavity for casting the projectile. Each mold half consists essentially of a first part of a metal having a high wettability for the lead or lead alloy being cast, the first metal parts of the mold halves defining the mold cavity, and a second part of a metal having a higher thermal conductivity than the first metal part, the second metal part being in heat conducting contact with the first part.

12 Claims, 5 Drawing Figures

PROJECTILE-CASTING INGOT MOLD

FIELD OF THE INVENTION

This invention relates generally to the casting of lead projectiles in projectile-casting ingot molds and more specifically to the manufacture of high-precision lead projectiles in projectile-casting ingot molds.

At the present time, projectile-casting ingot molds are used only by sports riflemen or in small industries for making lead projectiles for casting precisely shaped lead projectiles. Because the manufacturing tolerances of modern arms progressively decrease, lead projectiles must meet progressively higher requirements. The required dimensional accuracy required for high precision calls for a fit of an order of one hundredth of a millimeter between the two mold halves of the ingot mold and for perfect filling of the mold. The presently usual, shallow grooves of the barrel of the weapon match jacketed projectiles and previously made weapons with lead barrels differ in caliber and cartridge design from those which are made at the present time. For this reason the shape and the material of lead projectiles must consist of rather hard alloys because in case of soft lead projectiles the shallow grooves of the barrel of the weapons could shear the lead projectiles as a result of the acceleration of the projectile. In that case no spin would be imparted to the projectile and the latter would not be stabilized.

DESCRIPTION OF THE PRIOR ART

Known ingot molds for casting projectiles consist of two ingot mold halves, which are provided on their confronting sides with one or more projectile-forming cavities, into which the lead is poured. The ingot mold halves are provided on their sides facing away from each other with respective slots for receiving a holding device, such as hand-held tongs. A shear cover is provided on the top of the ingot mold and is pivoted to one of the ingot mold halves. Most of the known ingot molds for casting projectiles are made of cast iron although aluminum is also used as a material. The shear cover consists in most cases of steel.

On principle, good results in the casting of lead projectiles can be obtained with ingot molds made of any of the known materials (cast iron, brass, aluminum) but this will not be possible unless the casting sequence is carefully selected to match the lead alloy to be used, the pouring temperature and the casting rate. A substantially free selection of the casting rate is not consistent with the casting of projectiles meeting very high quality requirements.

In comparative tests it has been found that the conventional ingot molds have the following properties:

Projectile-casting ingot molds made of cast iron: Long operating life, resistance to abrasion by the shear cover, high wettability for the liquid lead so that the mold is completely filled, relatively low susceptibility to the lead alloy which is used. Eutectic alloys can be cast just as pure soft lead. But the slow heat dissipation of the ingot mold made of cast iron requires a slow casting process or drastic cooling methods, during which a uniform casting temperature cannot be maintained. After a few casts the dwell times until the liquid lead has solidified are progressively prolonged. Besides, when a certain relation of the temperature of the ingot molds to the temperature of the alloy is exceeded, an unattractive frosted skin will be formed on the projectiles. If the ingot mold is heated, it will promote the formation of lead-tin deposits at the edges of the mold for projectiles. This can be avoided only by a sufficiently strong cooling of the mold and by long solidification times so that any segregation of sintered material from the metal of the projectile will be avoided. Besides, the heavy weight of the ingot mold of cast iron results in a rapid fatigue in case of manual operation, particularly with relatively large multiple ingot molds.

Another disadvantage involved in the use of ingot molds of cast iron in industrial use resides in the risk of an increase in soiling of the ingot mold in case of high casting rates because parts of the liquid lead will adhere to deposits of dirt even in a thickness of less than 1/100 mm and will gradually build up so that the two halves of the ingot mold will quickly become acentric. Whereas cleaning with a soft grinding or polishing material or a razor blade can be performed quickly, the continual removal of the mold for cleaning precludes industrial use.

Ingot molds made of aluminum can be operated easily. Owing to their light weight they can be operated for a long time without fatigue. Because their thermal conductivity is high, the solidification time is very short. But that high thermal conductivity permits only high-quality alloys to be used if a satisfactory casting is to be obtained. Besides, the preliminary casting time until the ingot mold has reached the required temperature is longer and requires the alloy to be at a higher temperature than in an ingot mold made of cast iron. Pure soft lead can be cast only at temperatures which are so high that the natural expansion of the aluminum does not permit the casting of a precisely dimensioned bullet. The ingot mold must be heated to a much higher temperature than an ingot mold of cast iron and the shear cover will scrape splinters of the softer aluminum from the surface of the ingot mold. After some thousand casts, that shearing will result in casting defects at the base of the projectiles. Whereas that abrasion can be prevented by the use of high-temperature lubricants, they will soon give rise to cleaning problems because of adhering dirt particles.

It will be understood that the production of a precisely dimensioned, cast bullet is rendered more difficult by the low wettability of the aluminum for lead. As a result, scores tend to form in the projectile. The poor wettability also sometimes requires a higher pouring pressure, which can be exactly controlled only with difficulty. Vent lugs of lead may be formed in dependence on the alloy or in case of variations within an alloy. A high pressure and a highly fluid alloy will promote a formation of shrinkage cavities and/or air bubbles on the outside surface of the projectile.

Brass and bronze have basically the same disadvantages regarding casting technology as aluminum and are heavier in weight.

Bronze is used also for liners in ingot molds made of cast iron or steel so that the projectile-forming cavities can be machined more easily from the solid material. Whereas the lower wettability of the bronze for lead results in a quicker separation of the cast lead projectiles from the mold cavities, it involves the same disadvantages regarding casting technology as the use of aluminum. Such bronze liners have virtually no influence on the dissipation of heat because they are surrounded on all sides by the much larger mass of iron of the cast iron or steel ingot mold, which mass has a much lower thermal conductivity. For this reason bronze liners assume in continuous operation the same temperature as the remainder of the ingot mold of cast iron or steel.

In addition to the casting of lead projectiles, the cold-pressing of soft lead projectiles is known too. The projectiles thus made vary greatly in weight and are very soft so that the abrasion on the inside surfaces of the barrel is very high and the spin which is imparted is inadequate. During the shooting of cold-pressed lead projectiles the latter are inadequately stabilized and the barrel of the weapon is heavily soiled.

In the use of injection molds for injection molding of high-temperature alloys, such as copper, brass or bronze, under high pressure, it is known to use mold halves or at least the molding surface of each mold half of a tungsten-nickel-iron alloy, which contains at least 90 wt.% tungsten and can be processed by powder metallurgy and sintered at reasonable temperatures, to counteract the mechanical surface abrasion by the injected alloys. The injection molding of high-temperature alloys at about 955° C. requires entirely different casting conditions than the casting of lead projectiles.

It is known that composite casting molds may consist of a composite outer mold body and a replaceable composite mold liner, which constitutes a disposable part, having a long life and which is replaced while the outer mold body may be made of a material differing from that of the liner and is preserved so that the amount of scrap resulting from the wear of the mold is reduced.

OBJECTS OF THE INVENTION

It is an object of the invention to provide a projectile-casting ingot mold which permits making of castings having consistently precise dimensions at high casting rates.

Another object of the invention is the a projectile-casting ingot mold which permits high casting rates substantially independently of the lead alloy which is used while ensuring the making of projectiles having consistently precise dimensions.

SUMMARY OF THE INVENTION

In order to accomplish the objects stated, the invention provides a projectile-casting ingot mold which has an upper side and a lower side and defines at least one projectile-forming cavity, open toward the upper side of the ingot mold, which ingot mold comprises two ingot mold halves having abutting sides, which are formed each with one half of the projectile-shaped cavity, and wherein each ingot mold half comprises:

a first metal part defining the projectile-forming cavity half and which has a high wettability for lead alloys, and a second metal part adjoining the first metal part and having a higher thermal conductivity than the first metal part.

The high wettability of the first metal part in conjunction with the high heat dissipation from the second metal part permits an increase of the practical casting rate by as much as 60%. This will not result in so-called frosted castings caused by excessively hot lead which forms a rough surface and air-filled indentations disposed adjacent to the grooves. Such frosted castings will be avoided because the relative inequality between the temperature of liquid lead and of the ingot mold is maintained. The design in accordance with the invention results in a self-regulation of the projectile temperature and of the temperature of the ingot mold in the correct proportion so that an overheating of the ingot mold will be prevented in case of a continuous operation at a high casting rate. This ensures also in an unproblematic removal of the solidified projectiles from the molds because the solidification time remains constant.

In accordance with another aspect of the invention, each half of the ingot mold may consist of an iron part defining a respective half of the projectile-forming cavity, and an aluminum block, and either the iron part is embedded in the aluminum block or the aluminum block in the iron part.

In accordance with a further aspect of the invention, the iron part extends also over the upper side of the respective half of the ingot mold. That design will prevent wear of the upper side of the ingot mold by a shear cover.

In accordance with a further aspect of the invention, the venting during the casting operation is improved by a formation of fine grooves on the upper side of the ingot mold. As the liquid lead flows into the projectile-forming cavities, air leaving said cavities can escape through said fine grooves between the shear cover and the upper side of the ingot mold and said air will not entrain lead particles.

In order to improve the dissipation of heat from the aluminum block, the latter may be provided in accordance with the invention with outwardly open cooling slots.

In accordance with a further aspect of the invention, a projectile-casting ingot mold has a shear cover, consisting of an iron or steel part, which cooperates with the upper side of the ingot mold halves, and an aluminum part mounted on said iron or steel part. That design results in a faster solidification of the lugs formed on the projectiles, which lugs remain in the shear cover, and minimize the wear of the upper sides of the ingot mold halves and of the underside of the shear cover.

Also in accordance with the invention, the iron or steel part may be formed with pouring holes, which are provided with shearing edges and which communicate with a pouring trough formed in the aluminum part. That design ensures a neat shearing of the projectiles along the bottom of the projectile.

BRIEF DESCRIPTION OF THE DRAWINGS

Further aspects, advantages and features of the invention will become apparent from the following description of preferred illustrative embodiments of the invention with reference to the accompanying drawings, in which.

DESCRIPTION OF THE PREFERRED ILLUSTRATIVE EMBODIMENTS

Figure 1:
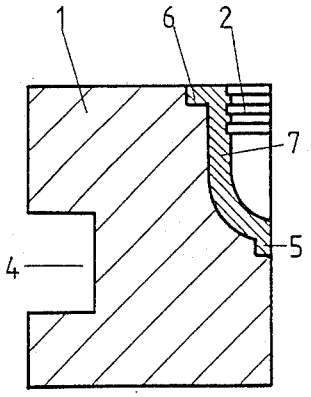
FIG. 1 is a transverse sectional view showing a first embodiment of one half of a projectile-casting ingot mold in accordance with the invention.

Only one half of a projectile-casting ingot mold is shown in FIGS. 1 to 4 because the second ingot mold half is a mirror image of the other.

Equivalent parts are designated with the same reference numerals in the several figures.

Figure 2:
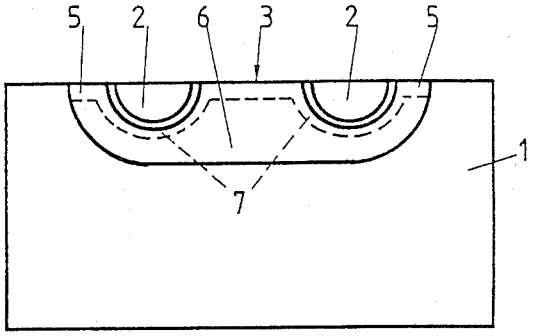
FIG. 2 shows the ingot mold half of FIG. 1 viewed from above.

In the embodiment shown in FIGS. 1 and 2, the projectile-casting ingot mold consists of an aluminum block 1, in which a core 3 made of iron, cast iron or steel and defining a projectile-forming cavity half 2 is embedded on that side which faces the other ingot mold half, not shown. On that side of the aluminum block 1 which is remote from the other ingot mold half, not shown, the aluminum block 1 is provided with a longitudinal groove 4 for receiving holding means, not shown. The core 3 consists of a vertical longitudinal wall 5, which adjoins the parting plane of the ingot mold, a horizontal flange 6, which adjoins the upper side of the ingot mold, and molding sleeve 7, which surrounds the projectile-forming cavity half 2 and merges into the longitudinal wall 5 and the flange 6, respectively.

Figure 3:
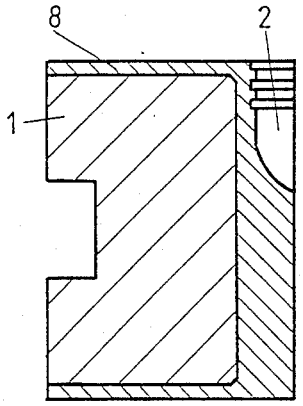
FIG. 3 is a transverse sectional view showing a second embodiment of one half of a projectile-casting ingot mold.
Figure 4:
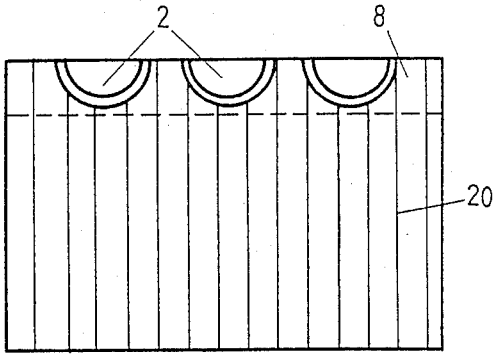
FIG. 4 is a top plan view showing the ingot mold half of FIG. 3

The illustrative embodiment shown in FIGS. 3 and 4 comprises a cast iron or steel part 8, which is C-shaped in cross-section and encloses the aluminum block 1 on three sides. The C-shaped cast iron or steel part 8 extends throughout the parting plane of the ingot mold and throughout the upper or lower side of the ingot mold. The halves 2 of the projectile-forming cavity are arranged in that portion of the cast iron or steel part 8 which adjoins the parting plane and the upper side of the ingot mold.

Figure 5:
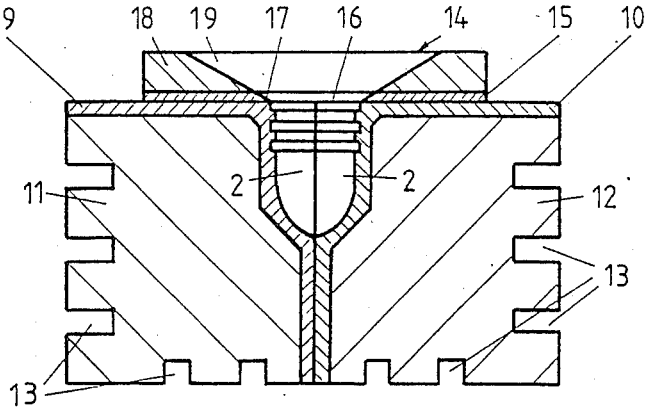
FIG. 5 is a sectional view showing another embodiment of a projectile-casting ingot mold.

In the illustrative embodiment shown in FIG. 5, the iron part 9 and 10 of either ingot mold half extends over the upper side of the ingot mold half and over that side thereof which faces the other ingot mold half so that the two iron parts 9, 10 are T-shaped in cross-section. Each of the two iron parts 9, 10 is embedded in an aluminum block 11, 12, which is formed with outwardly open cooling slots 13 on its underside and on that side which faces away from the other ingot mold half. A shear cover 14 rests on the upper side of the ingot mold halves or the iron parts 9, 10 and is adapted to be displaced or pivotally moved on that upper side by means which are not shown. That shear cover 14 consists of an iron or steel part 15, which rests on the upper side of the ingot mold and is formed with pouring holes 16 equal in number to the projectile-forming cavities in the ingot mold. The edges of said holes consist of knifelike shearing edges 17. Said holes are aligned with the projectile-forming cavities of the ingot mold. The shear cover also consists of an aluminum part 18, which is mounted on the iron or steel part 15 and has a pouring trough 19, which extends over and connects all pouring holes 16.

The ingot mold in accordance with the invention may be made by a casting process. Alternatively, the iron part which contains the halves of the projectiles-molding cavities may be made of sheet metal, particularly sheet steel, and may be embedded in a casting mold, into which liquid aluminum is then cast.

The upper side of the ingot mold may be formed with fine grooves 20 preferably having a depth of 0.02 to 0.03 mm.

Projectile-casting ingot molds in accordance with the invention have been tested in comparison with known ingot molds. Type lead, projectile lead and pure lead were used in the test.

Type lead has an average composition of 4% tin, 8–12% antimony, 88% lead and is highly fluid at 316° C. and does no longer shrink.

Projectile lead is composed of 2% tin, 6% antimony, 92% lead and is highly fluid at 370° C. and has a shrinkage of 0.01 mm or less.

Pure soft lead: The flowability required for a casting of precision bullets is achieved at temperatures in excess of 427° C. The shrinkage in the cold is about 0.02 to 0.05 mm, depending on the caliber of the projectile.

Casting was performed without an external cooling of the ingot mold. The time was measured in which the pouring had to be slowed down in order to avoid the solidification problems which arose.

First test series with type lead, pouring temperature 316° C.:

Ingot molds made of cast iron:

In dependence on the number of pouring holes or projectile-forming cavities (2–10), the time elapsing until it was necessary to reduce the casting rate varied between 10 and 15 casts. If the casting is continuous, tin-lead streaks are formed between the cover and the ingot mold and the alloy begins to creep into the venting passages to form flash.

Ingot molds made of aluminum:

In dependence on the number of pouring holes and projectile-forming cavities (2–4), 5 to 10 casts were required before the ingot mold was at the required temperature. Thin or pointed shapes can be cast only at temperatures of and above 344°–371° C. But in that case the type lead used has such a high fluidity that there is always a risk of a formation of vent lugs. The casting rate need not be slowed down until about 25 to 30 casts have been made. If a lower casting rate is maintained, no external cooling is required at all. No lead streaks are formed.

Ingot molds made of brass:

Like ingot molds made of aluminum.

Ingot mold in accordance with the invention:

The required quality projectiles are made after only two casts. The initial rate must be reduced after about 20 to 25 casts. But an external cooling is not required in case of a slower, continuous casting. Second Test series with soft lead, pouring temperature 455° C.

Ingot mold made of cast iron:

Castings of high quality were obtained after 3–4 casts. But the ingot mold was overheated after 5–8 casts. External cooling was required in case of continuous casting operations.

Ingot mold made of aluminum:

Useful results were not obtained. A casting of sharp edges was possible only under a very high pouring pressure. Long projectiles (having a length of more than 2 calibers) and a thin nose cannot be produced in high quality.

Ingot molds made of brass:

Like ingot molds made of aluminum.

Ingot mold in accordance with the invention:

The castings were of high quality after 2 to 4 casts. The casting rate need not be decreased until 20 to 30 casts have been made. No external cooling is required in case of a continuous casting at low rate.

Third test series with bullet lead:

The ingot molds were now subjected to a long-term test. The pouring temperature was selected in each case in dependence on the alloy and the ingot mold and external cooling was effected in case of need. Maximum time per test 12 hours.

Ingot molds made of cast iron:

There was no change of the ingot mold but deposits on the edges of the ingot mold required a removal and cleaning of the mold. Slight formation of streaks on the shear cover. The cooling cannot be exactly controlled.

Even a slight undertemperature results in a wrinkled surface or a formation of incomplete edges.

Ingot mold made of aluminum:

The shear cover had to be readjusted after a continuous operation for only 8 hours because the bottom of the projectile was no longer exactly cast. The casting operation could not be resumed until the shear cover had been smoothened and after-treated with solid lubricant.

Another test for 12 hours showed that said afterlubrication had to be repeated whenever about 8 to 12 hours had passed. The interval depends on the pouring temperature, i.e., on the lead alloy.

Ingot molds made of brass:

Abrasion began after 6 hours. A very careful monitoring was required to prevent the mold from becoming entirely unusable. The test was discontinued after 8 hours.

Ingot mold in accordance with the invention:

There was no abrasion and no formation of streaks or other deposits after a continuous operation for 12 hours. The casting rate could be changed as desired without an immediate influence on the external cooling requirement.

What I claim is:

1. An ingot mold for casting a lead or lead alloy projectile, the mold comprising two like ingot mold halves having abutting sides and upper and lower sides extending outwardly therefrom, the abutting mold half sides defining like cavity halves open towards the upper sides of the mold halves and forming a mold cavity for casting the projectile, and each mold half consisting essentially of a first part of a metal having a high wettability for the lead or lead alloy being cast, the first metal parts of the mold halves defining the mold cavity, and a second part of a metal having a higher thermal conductivity than the first metal part, the second metal part being in heat conducting contact with the first part.

2. The projectile-casting ingot mold according to claim 1, wherein the first metal part has a smaller volume than the second metal part.

3. A projectile-casting ingot mold according to claim 2, further comprising a shear cover lying on the upper sides of the ingot mold halves and having an iron part defining pouring holes equal in number to a number of projectile-forming cavities in the mold and an aluminum part mounted on the iron part and defining a pouring trough communicating with the pouring holes, the pouring holes having shearing edges.

4. A projectile-casting ingot mold according to claim 2, wherein the first metal part is an iron part.

5. A projectile-casting ingot mold according to claim 2, wherein the first metal part is a cast iron part.

6. A projectile-casting ingot mold according to claim 2, wherein the first metal part is a steel part.

7. A projectile-casting ingot mold according to claim 2, wherein the second metal part is an aluminum part.

8. A projectile-casting ingot mold according to claim 2, wherein the first metal part is embedded in the second metal part.

9. A projectile-casting ingot mold according to claim 2, wherein the second metal part is embedded in the first metal part, the first metal part constituting the upper, lower and abutting sides of the ingot mold half.

10. A projectile-casting ingot mold according to claim 2, wherein the first metal part constitutes the upper side of the ingot mold half.

11. A projectile-casting ingot mold according to claim 10, wherein the first metal part has fine grooves on that upper side of the ingot mold half.

12. A projectile-casting ingot mold half according to claim 2, wherein the second metal part is provided with outwardly open cooling slots.

* * * * *